US007001282B1

(12) United States Patent
Jennings

(10) Patent No.: US 7,001,282 B1
(45) Date of Patent: Feb. 21, 2006

(54) BASEBALL WATER SLIDE APPARATUS

(76) Inventor: Linda H. Jennings, 5836 Logancraft Dr., Dallas, TX (US) 75227

( * ) Notice: Subject to any disclaimer, the term of this patent is extended or adjusted under 35 U.S.C. 154(b) by 0 days.

(21) Appl. No.: 10/943,681

(22) Filed: Sep. 20, 2004

(51) Int. Cl.
*A62G 21/18* (2006.01)

(52) U.S. Cl. ..... 472/117; 472/128

(58) Field of Classification Search ..... 472/116, 472/117, 128, 129; 473/422, 451; 434/247, 434/251, 255
See application file for complete search history.

(56) References Cited

U.S. PATENT DOCUMENTS 3,363,268 A * 1/1968 Friedlander ..... 4/506
4,645,206 A 2/1987 Todd
4,762,316 A 8/1988 Merino
4,887,811 A * 12/1989 Tresh ..... 473/451
5,154,671 A 10/1992 Smollar et al.
5,556,090 A 9/1996 Coleman
D382,619 S 8/1997 Peterson
6,062,983 A * 5/2000 Butsook ..... 472/117
6,106,416 A 8/2000 Ward
D445,331 S 7/2001 Udwin et al.
6,692,257 B1 * 2/2004 Branum et al. ..... 434/247

* cited by examiner

*Primary Examiner*—Kien Nguyen

(57) ABSTRACT

A baseball water slide apparatus includes a panel that has a top side and a peripheral edge. The panel is flexible and has a substantially square shape. A loop member is attached to the top side. The loop member is hollow and defines a tube. The loop member is positioned adjacent to and extends along the peripheral edge of the panel. The loop member has a plurality of apertures extending through that are each directed generally inward of the panel. An inlet hose is fluidly coupled to the loop member. A water supply may be removably coupled to the inlet hose such that water may be supplied to the loop member. A plurality of bases is attached to the top side of the panel. Each of the bases is positioned adjacent to one of four corners of the panel.

8 Claims, 3 Drawing Sheets

BASEBALL WATER SLIDE APPARATUS

BACKGROUND OF THE INVENTION

1. Field of the Invention

The present invention relates to water slide devices and more particularly pertains to a new water slide device for allowing children to play a game similar to baseball on a surface that is covered with water and is slippery for allowing generally risk free sliding thereon.

2. Description of the Prior Art

The use of water slide devices is known in the prior art. U.S. Pat. No. 4,762,316 describes a device that includes a slide which simulates a wave for surfing upon. Another type of water slide device is U.S. Pat. No. 5,154,671 having an elongated plastic onto which water is positioned so that children may slide down the wet plastic and into a pool. Baseball devices for children are also known. U.S. Pat. No. 6,106,416 describes a baseball like game that utilizes a sponge ball.

While these devices fulfill their respective, particular objectives and requirements, the need remains for a device that combines the fun of playing baseball with the enjoyment of sliding on a flexible panel covered with water. Such a game would allow children to slide into bases without danger of getting hurt while at the same time allowing them to play baseball in the water.

SUMMARY OF THE INVENTION

The present invention meets the needs presented above by generally comprising a panel that has a top side, a bottom side and a peripheral edge. The panel is flexible and has a substantially square shape such that four corners of the panel are defined. A loop member is attached to the top side. The loop member is hollow and defines a tube. The loop member is positioned adjacent to and extends along the peripheral edge of the panel. The loop member has a plurality of apertures extending through that are each directed generally inward of the panel. An inlet hose is fluidly coupled to the loop member. The inlet hose has a free end having a threaded coupler attached thereto. A water supply may be removably coupled to the inlet hose such that water may be supplied to the loop member. A plurality of bases is attached to the top side of the panel. Each of the bases is positioned adjacent to one of the corners.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
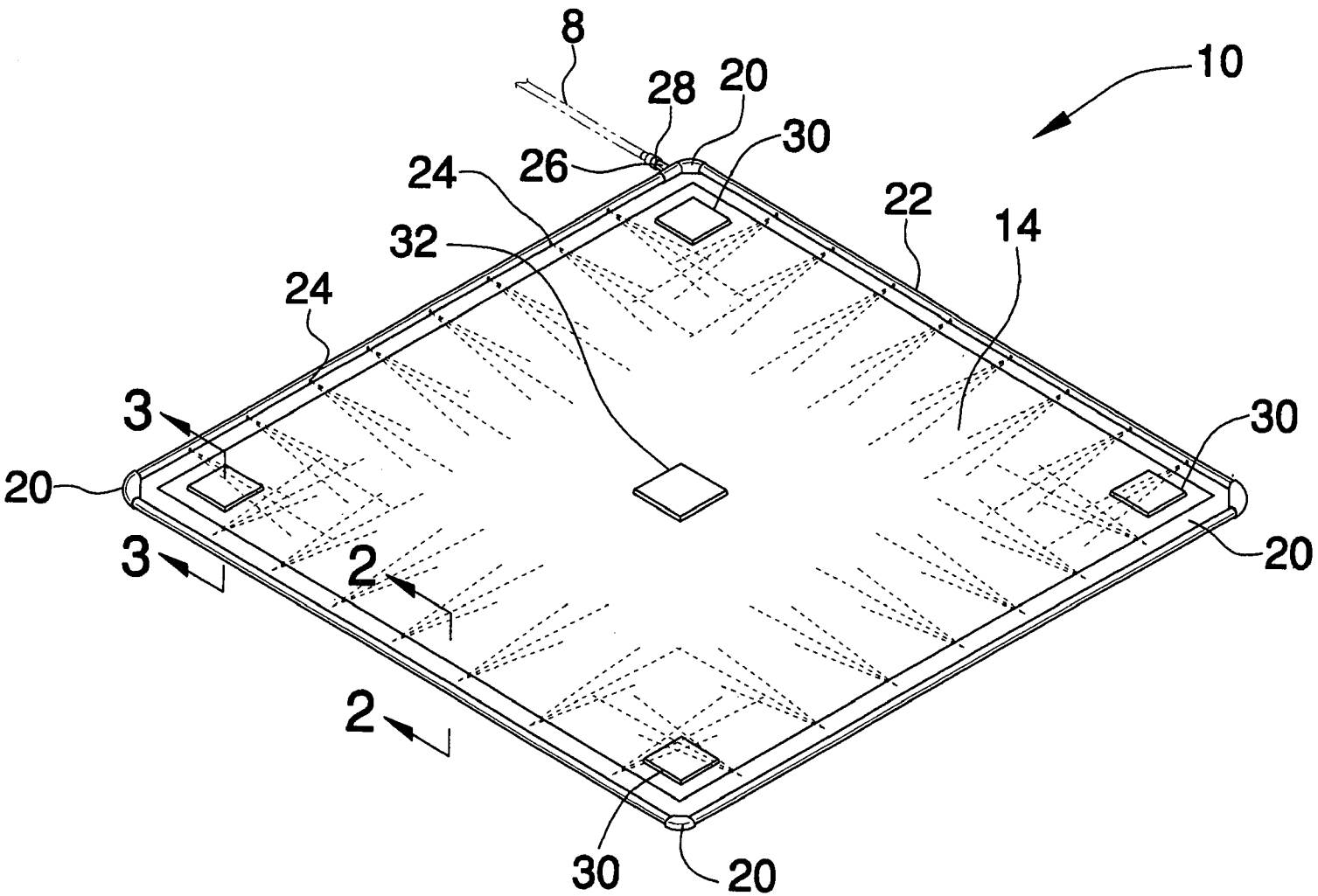
FIG. 1 is a perspective view of a baseball water slide apparatus according to the present invention.
Figure 2:
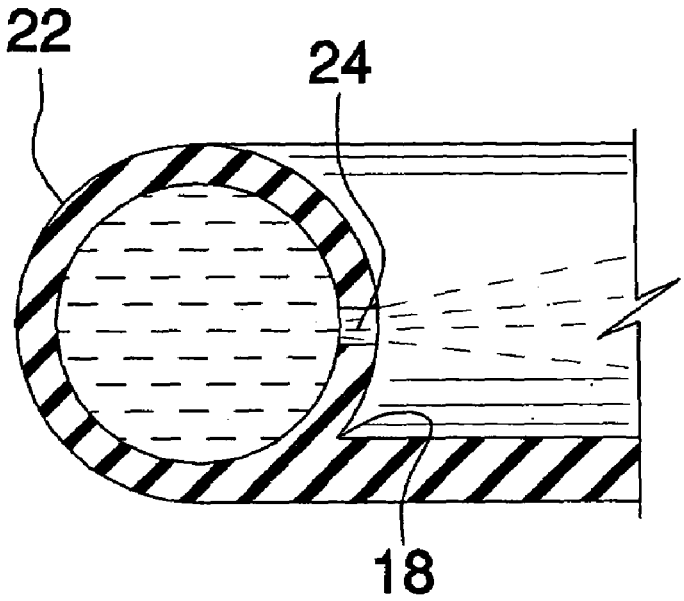
FIG. 2 is a cross-sectional view taken along line 2—2 of FIG. 1 of the present invention.
Figure 3:
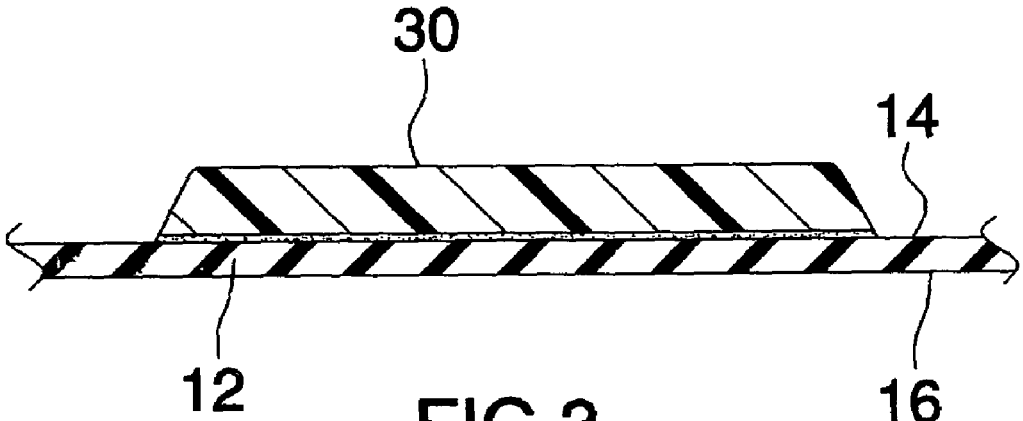
FIG. 3 is a cross-sectional view taken along line 3—3 of FIG. 1 of the present invention.
Figure 4:
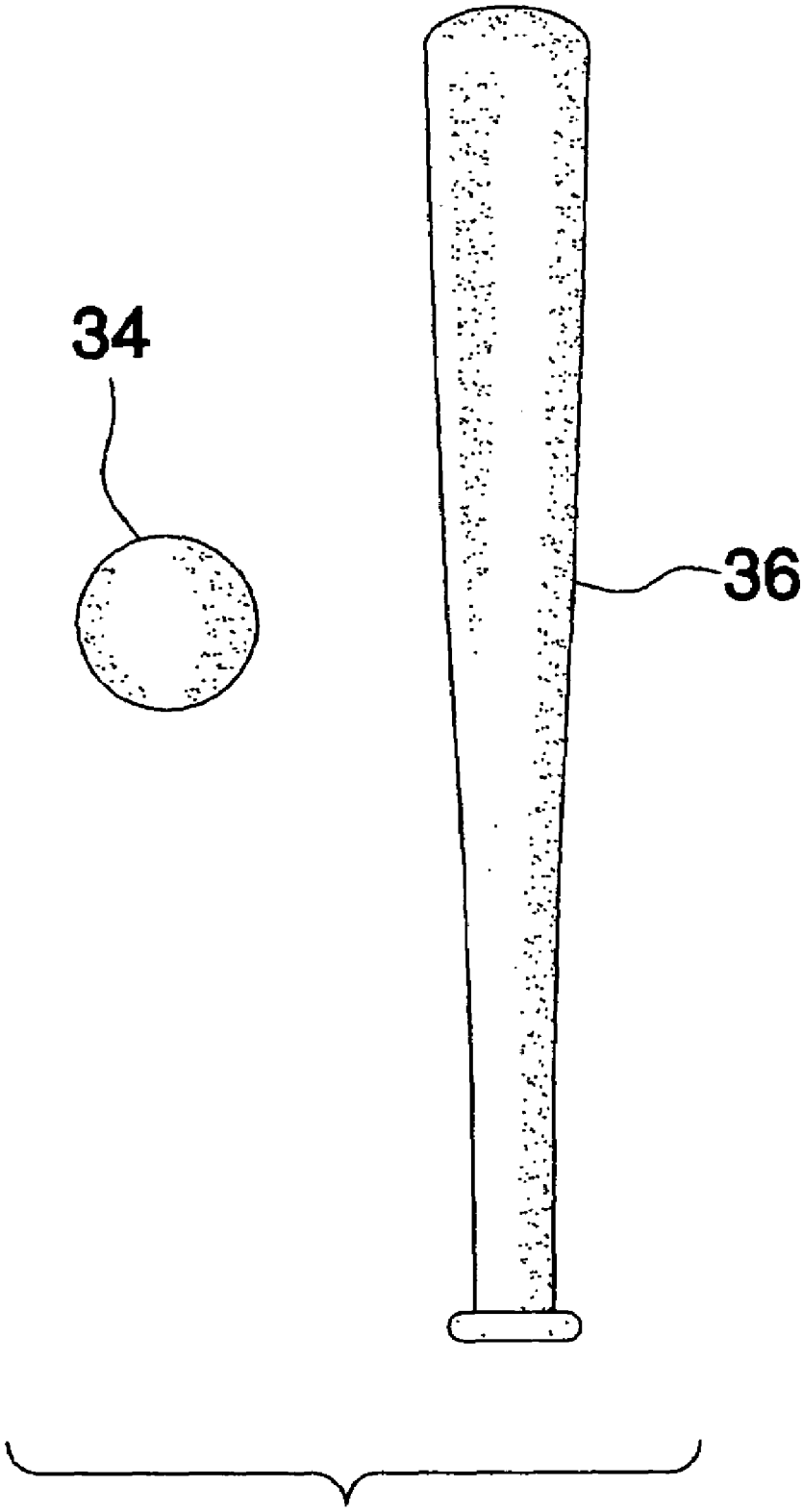
FIG. 4 is a front view of a bat and ball of the present invention.

With reference now to the drawings, and in particular to FIGS. 1 through 4 thereof, a new water slide device embodying the principles and concepts of the present invention and generally designated by the reference numeral 10 will be described.

As best illustrated in FIGS. 1 through 4, the baseball water slide apparatus 10 generally comprises a panel 12 that has a top side 14, a bottom side 16 and a peripheral edge 18. The panel 12 is flexible and comprises a plastic material which may or may not be a mat having cushioning therein. The panel 12 has a substantially square shape such that four corners 20 of the panel are defined. The panel 12 has a length and width each is greater than 50 feet and more preferably greater than 75 feet.

A loop member 22 is attached to the top side 14. The loop member 22 is hollow and defines a tube or hose. The loop member 22 is positioned adjacent to and extends along the peripheral edge 18 of the panel 12. The loop member 22 has a plurality of apertures 24 extending through. Each of the apertures 24 is directed generally inward of the panel 14. An inlet hose 26 is fluidly coupled to the loop member 22. The inlet hose 26 has a free end to which is coupled a threaded coupler 28 adapted for fluidly coupling to a conventional water hose. A water supply 8 may be removably coupled to the inlet hose 26 so that water may be supplied to the loop member 22. The direction of the apertures 24 allows the water to be ejected onto the top side 14 the panel 12.

A plurality of bases 30 is attached to the top side 14 of the panel 12. Each of the bases 30 is positioned adjacent to one of the corners 20. The bases 30 each comprise a relatively soft and flexible plastic material. A pitchers plate 32 is attached to the top side 14 of the panel 12 and is generally centrally located on the panel 12. The pitchers plate 32 also comprises a relatively soft and flexible plastic material. The bases 30 and pitchers plate 32 may each be hollow to enhance their softness.

At least one, and preferably a plurality of balls 34 are provided. The ball 34 or balls are preferably comprised of a foamed elastomer. Also provided is a bat 36 that is also comprised of a foamed elastomer though the bat may also be made of a plastic material. The balls 34 may be comprised of conventional sponge material adapted for soaking up water.

In use, the panel 12 is spread on a ground surface which is preferably covered with grass so that the panel 12 rests on a relatively soft surface. The loop member 22 is fluidly coupled to the water supply 8 and the water is turned on. The water is ejected through the apertures 24 to wet down the areas between the bases 30. Users of the apparatus 10 then proceed to use the panel 12 as a traditional baseball diamond while the water is being sprayed onto the panel 12. As children run between the bases 30, the can slide on the panel 12 which is made slippery with the water. Typically, the conventional rules of baseball will be applied however the users may make up new rules as desired. The panel 12 and water allow children to slide without fear of injury while also allowing them to get wet.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A baseball diamond and water slide combination device comprising a panel having a top side, a bottom side and a peripheral edge, said panel being flexible, said panel having a substantially square shape such that four corners of said panel are defined;

a loop member being attached to said top side, said loop member being hollow and defining a tube, said loop member being positioned adjacent to and extending along said peripheral edge of said panel, said loop member having a plurality of apertures extending through, each of said apertures being directed generally inward of said panel;

an inlet hose being fluidly coupled to said loop member, said inlet hose having a free end, a threaded coupler being attached to said free end, wherein a water supply may be removably coupled to said inlet hose such that water may be supplied to said loop member; and a plurality of bases being attached to said top side of said panel, each of said bases being positioned adjacent to one of said corners.

2. The device according to claim 1, wherein said panel has a length and width each being greater than 50 feet.

3. The device according to claim 1, wherein said panel has a length and width each being greater than 75 feet.

4. The device according to claim 1, wherein each of said bases comprises a flexible plastic material.

5. The device according to claim 4, further including a pitchers plate being attached to said top side of said panel, said pitchers plate being generally centrally located on said panel, said pitchers plate comprising a flexible plastic material.

6. The device according to claim 1, further including a pitchers plate being attached top said top side of said panel, said pitchers plate being generally centrally located on said panel.

7. The device according to claim 1, further including a ball comprising a foamed elastomer and a bat comprising a foamed elastomer, each of said ball and bat being water absorptive.

8. A baseball diamond and water slide combination device comprising:

a panel having a top side, a bottom side and a peripheral edge, said panel being flexible and comprising a plastic material, said panel having a substantially square shape such that four corners of said panel are defined, said panel having a length and width each being greater than 50 feet;

a loop member being attached to said top side, said loop member being hollow and defining a tube, said loop member being positioned adjacent to and extending along said peripheral edge of said panel, said loop member having a plurality of apertures extending through, each of said apertures being directed generally inward of said panel;

an inlet hose being fluidly coupled to said loop member, said inlet hose having a free end, a threaded coupler being attached to said free end, wherein a water supply may be removably coupled to said inlet hose such that water may be supplied to said loop member;

a plurality of bases being attached to said top side of said panel, each of said bases being positioned adjacent to one of said corners, each of said bases comprising a flexible plastic material; a pitchers plate being attached to said top side of said panel, said pitchers plate being generally centrally located on said panel, said pitchers plate comprising a flexible plastic material;

a ball comprising a foamed elastomer; and a bat comprising a foamed elastomer.

* * * * *